United States Patent [19]

Allen

[11] Patent Number: 4,532,707

[45] Date of Patent: Aug. 6, 1985

[54] ANIMAL HAIR SHEAR AND CUTTING DEVICE

[75] Inventor: Gary D. Allen, Allen, Tex.

[73] Assignee: Stone Manufacturing & Supply Co., Kansas City, Mo.

[21] Appl. No.: 445,415

[22] Filed: Feb. 16, 1983

[51] Int. Cl.[3] ..... B26B 19/24

[52] U.S. Cl. ..... 30/200; 30/201

[58] Field of Search ..... 30/200, 201, 208, 202

[56] References Cited

U.S. PATENT DOCUMENTS

| | | | |
|---|---|---|---|
| 233,695 | 10/1880 | Priest | 30/201 |
| 869,500 | 10/1907 | Martin | 30/200 |
| 1,496,334 | 6/1924 | Ziegler | 30/200 |
| 1,899,102 | 2/1933 | Michael | 30/202 |
| 1,988,199 | 1/1935 | Greco et al. | 30/202 |
| 2,024,220 | 12/1935 | Havens | 30/202 |
| 2,480,920 | 9/1949 | Gullong | 30/202 |
| 2,768,438 | 10/1956 | Coggins | 30/200 |
| 3,844,036 | 10/1974 | Wahl | 30/200 |
| 3,969,819 | 7/1976 | Pepera | 30/200 |

*Primary Examiner*—Jimmy C. Peters

*Attorney, Agent, or Firm*—Warren H. Kintzinger

[57] ABSTRACT

An electrically operated animal hair shear or cutting device including an electric motor housing, hair cutting blade means and a conventional toothed comb member carried by the device, and a second comb member carried by the device with the first comb member disposed between the blade means and the second comb member in spaced relation. The same device mounting apertures and mounting means for the first comb member may be employed to detachably mount the second comb means to the device.

5 Claims, 6 Drawing Figures

FIG. 4
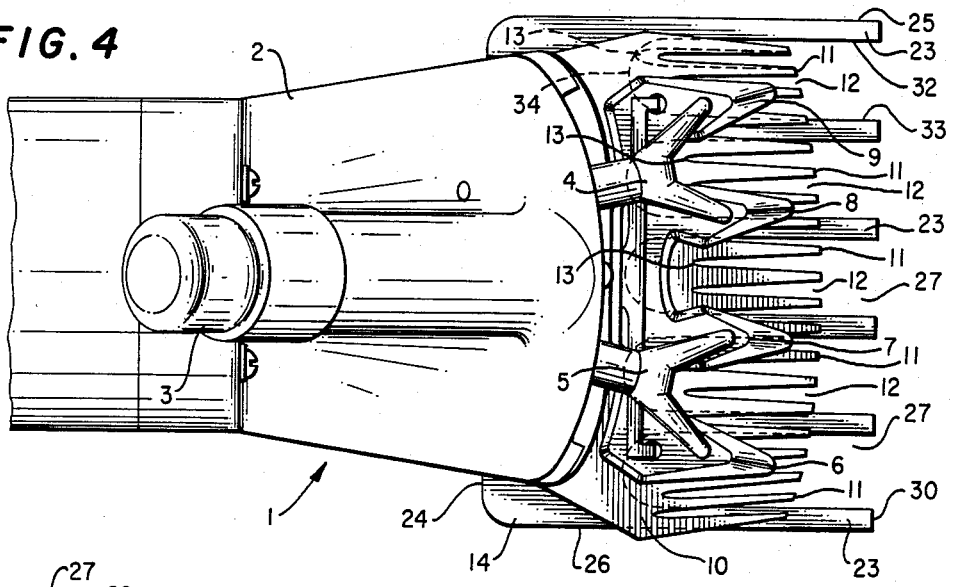
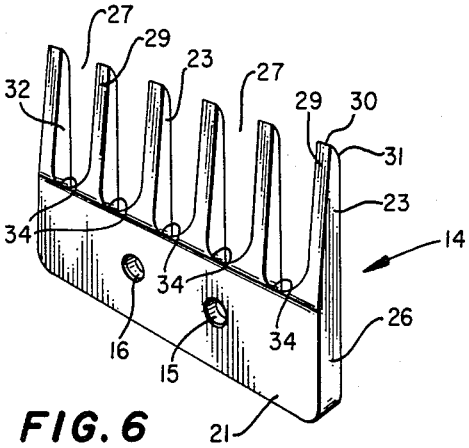
FIG. 6
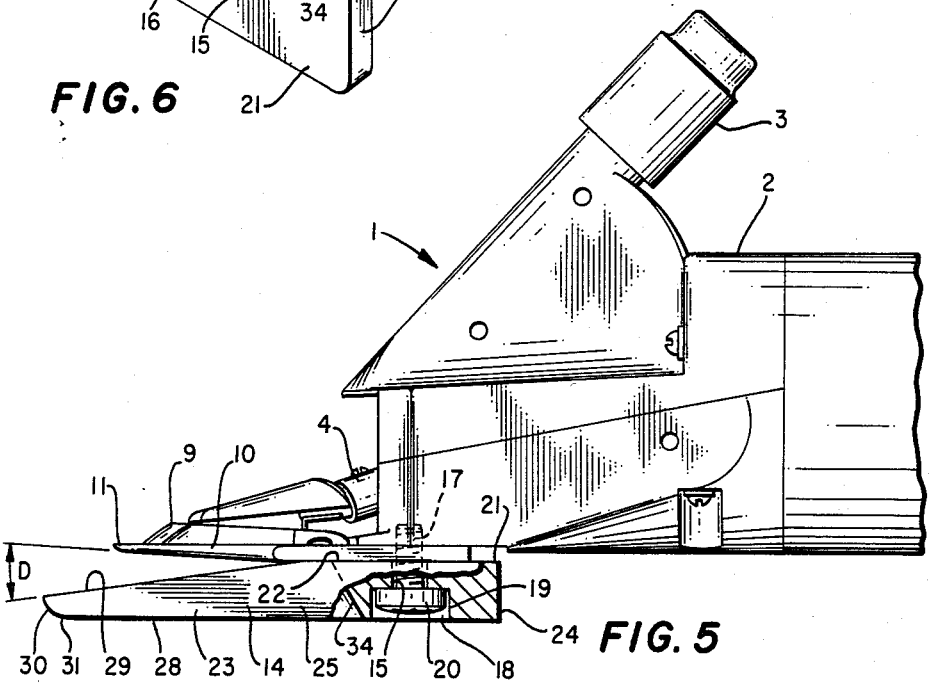
FIG. 5

ANIMAL HAIR SHEAR AND CUTTING DEVICE

This invention relates to animal hair shear or cutting devices and is more particularly directed to an animal shear or cutting device, such as sheep shears, including a one-piece detachable second auxiliary comb member cooperating with the conventional comb member utilized presently with prior art animal shear devices.

Heretofore, prior art animal shear devices included a comb member, located beneath a plurality of cutting blades, which acted not only to attempt to raise the animal's hair for cutting but also as a safety guard for the person cutting the animal's hair. The animal tended to attempt to loosen itself from the person's grip while the person was cutting the animal's hair slowing down the cutting operation efficiency. In addition, at cutting time and without grooming, hairs on the animal bunch up, mat, become tangled, form twists, intertwine and, in general, present to the person attempting to shear the animal, randomly oriented hair masses. The conventional comb has a plurality of closely adjacent spaced, small, short length teeth or tines in almost abuting engagement with the plurality of laterally reciprocating hair cutting blades, usually larger in size but lesser in number than the comb teeth or tines which do not permit time for untangling of the matted animal's hair at the cutting blades. The cutting blades are generally formed from a single blank and the blades are reciprocated within limits by a pair of reciprocating arms operated by an electric motor which also reinforce or strengthen the blades during the cutting operation. The upper surface of the conventional comb members are flat as are the facing surfaces of the blades, in that the facing surfaces of the conventional comb and blades are almost in touching engagement, although some prior art shear devices permit slight adjustment to move the blades towards and away from the fixed comb to adjust the spacing there between.

The blades and conventional comb of prior art shear or cutting devices are angled upwardly from the motor containing housing requiring the person using the shear device to assume an uncomfortable wrist and elbow position or to angle the animal causing it to fight and squirm more to get loose from the shearer during the shearing operation. This angling of the blade and comb increases the chances of the shearer being cut or the animal being out or both.

It is, therefore, a principal object of the present invention to provide new and improved animal hair shear or cutting devices overcoming the aforementioned difficulties and problems, among others, of the prior art.

Another object of the present invention is to provide such a cutting device with a second detachable comb member spaced from but which cooperates with the conventional comb member to enhance the cutting efficiency of the device.

Still another object of the present invention is to provide such devices with a second detachable comb member which may be mounted to the device by utilizing the mounting apertures and mounting means employed to secure the conventional first comb member to the device.

A further object of the present invention is to provide such a device which initially contacts the animal matted hair to condition the hair for efficient cutting and then cooperates with the conventional comb to further condition the hair for efficient hair cutting.

A still further object of the present invention is to minimize the safety hazards to both the cutter and the animal.

Another object of the present invention is to provide a comb member for attachment to a shear or animal hair cutting device which cooperates with the conventional comb member and cutting blades to enhance the efficiency of the hair cutting operation.

Features of the invention useful in accomplishing the above objects include, an electrically operated animal hair shearing or clipping device having an electric motor housing, blade means reciprocable laterally by the motor, a first comb member carried by the device adjacent the blade means and a detachable second comb member, carried by the device adjacent the first comb member, the first comb member being disposed between the blade means and the second comb member.

The first comb member may be angled outwardly and upwardly from the motor housing with the second comb member extending substantially parallel with the bottom of the device to define between the comb members a hair receiving and conditioning space converging from the outer ends of the comb members to the motor housing for untangling the matted animal hair. The second comb member is provided with fewer teeth than the first comb member with the outer ends of the teeth extending further outwardly than the teeth of the first comb member thereby providing a plurality of grooves or channels between the teeth of the second comb member which are wider than the grooves or channels between the teeth of the first comb member. The second detachable comb member is provided with a flat surface for mounting to the device and the same apertures in the device for mounting the first comb member are also used for mounting the second comb member.

Specific embodiments representing what are presently regarded as the best modes of carrying out the invention are illustrated in the accompanying drawings.

IN THE DRAWINGS

FIG. 4 is a top plan view of the device of FIG. 1;

FIG. 5 is a view of the device similar to FIG. 1 but indicating use of a secondary comb member of smaller dimensions than the comb member of FIG. 2; and, FIG. 6 is a perspective view of the comb member of FIG. 5 mounted on the device of FIG. 5.

REFERRING TO THE DRAWINGS

Figure 1:
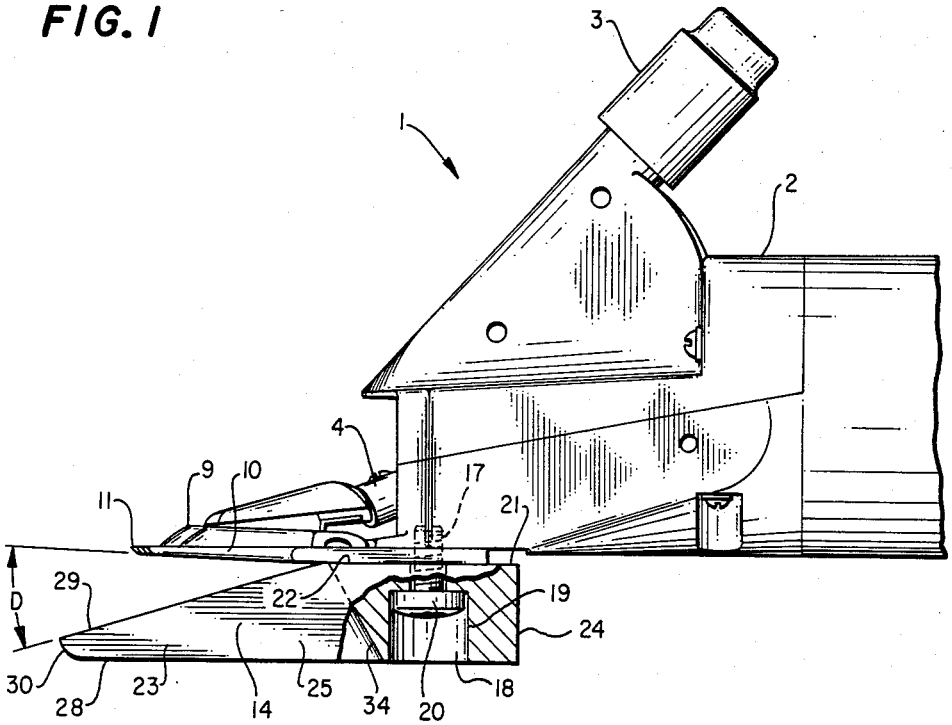
FIG. 1 is an enlarged fragmentary side view in partial section of a shear clipper device constructed in accordance with the present invention.

FIGS. 1–4 are directed to a preferred embodiment of shear or clipper device generally indicated by the numeral 1, constructed with the principles of the present invention.

The device 1 is of generally conventional construction including an electric motor housing 2, cutting blade and primary comb member adjusting knob means 3, cutting blade reciprocating means 4 and 5 (FIG. 4) a plurality of spaced upwardly angled cutting blades 6, 7, 8, and 9, (FIG. 4) and a one piece upwardly angled primary comb member 10 having a plurality of closely spaced teeth or tines 11, the outer ends of which teeth 11 project beyond the adjacent outer ends of the shear or clipping blades 6–9.

The clipping blades 6–9 are maintained in closely spaced relation adjacent the flat upper surface of the comb member 10 and reciprocate laterally to cut the animal's hair captured between the flat upper surface of the comb 10 and the blade 6–9. The adjacent teeth 11 of the comb member 10 define hair guide grooves 12 which diverge from body 2 to their outer ends and are arcuately formed near the body 2 with a terminal downward slop 13 (FIG. 1) closely adjacent the body 2 to permit ease of passage of already cut hair from the device 1.

With this conventional device as thus described, the person using the device grasp the animal, for example, a sheep, and shears or clips the hair from the animal which hair as aforesaid, may be tangled, twisted, matted, intertwined or include entrapped foreign matter. The condition of the hair, therefore, may slow down the efficiency of the clipping time requiring several swipes of the device over the same hair area, may cause the animal to increase its efforts to escape confinement by the shearer even further slowing down the clipping time and presents safety hazards to both the shearer and the animal.

The angle of the blades and comb 10 impose an awkward strain on the shearer wrist and arms as the animal moves about. The proximity of the outer ends of the blades 6–9 and the comb teeth 11 do not allow sufficient time for tangled and matted hair to be unsnarled by the comb before cutting begins. The close proximity of the teeth 11 defining the very narrow grooves 12 and the convergence of the teeth 11 toward the body do not enhance untangling of the matted and snarled hair and the small all but useless slopes 13 permit the cut and uncut hair to tangle together making cutting harder to accomplish over time and the variable stress on the cutting blades caused thereby shortens the use life of the device.

Figure 2:
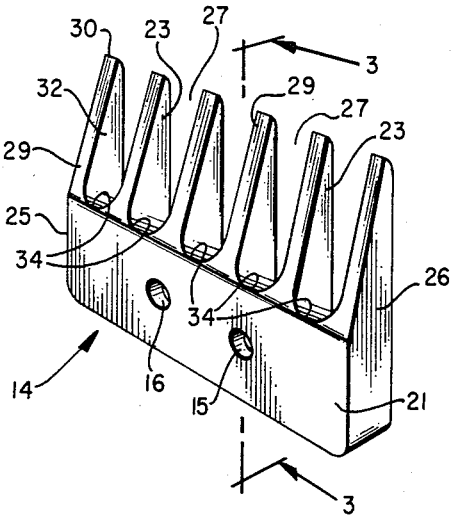
FIG. 2 is a perspective view of a secondary comb member of FIG. 1.
Figure 3:
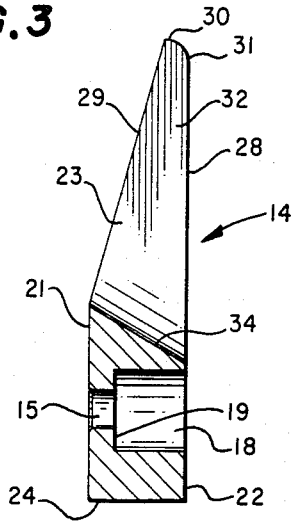
FIG. 3 is a view in partial section taken along line 3—3 of FIG. 2.

As illustrated in FIGS. 1–4 and refering particularly to FIG. 2, the present invention incorporates a second detachable comb 14 constructed of metal and preferably of light weight metal, such as aluminum, which may be attached to the body 2 utilizing the same thread holes existing in presently available shear or clipping devices 1 for securing the primary comb 10 to the body 2. As shown in FIGS. 2 and 3, the secondary comb 14 has a pair of apertures 15 and 16 therethrough to receive threaded bolt member 17 (one of which is shown in FIG. 1). The apertures 15 and 16 are each countersunk, as at 18, to define a locking shoulder 19 for engagement by the head 20 of the threaded bolt 17. Thus the same existing threaded holes used to secure the primary comb member 10 to the body 2 can be employed to secure also the secondary comb member 14, to the body 2, utilizing only two threaded bolts 17.

In configuration, the second comb member 14 is thicker than the primary comb member 10 and is provided with a flat inner surface section 21, an opposite flat outer surface section 22 and a plurality of teeth or tines 23. The rear 24 of the comb member 14 is flat as are the outer surfaces 25 and 26 of the end opposite tines 23. The teeth 23 are lesser in number than the teeth of the comb 10, 6 teeth 23 being shown for illustration purposes. The spacing or grooves 27 of the teeth 23 is much greater than the grooves 12 of the comb 10 and are not divergent like the teeth 11 of the comb 10. The bottom surface 28 of the comb 14 is flat, and provides a surface continuity with the section 22 (FIGS. 1 and 3). The upper surface of the teeth 23 slope angularily downwardly as at 29 and extend to the outer ends 30 a substantial distance further than the corresponding outer ends of the plurality of teeth 11 of the comb 10. The bottoms 31 of the teeth 23 curve upwardly to facilitate entrance of the animal's hair into the grooves 27 and provide a longer path for unsnarling and untangling of the animal's hair before the cutting operation occurs.

The opposite facing inside surfaces 32 and 33 are straight and flat to gather larger crops of hair and join adjacent the body 2 in a downwardly sloped accurate portion 34 which cooperate with the comparable arcuate surface 13 of the comb 10 to facilitate removal of cut hair from the device 1.

It will be observed that when the comb 14 is mounted in the device 1 an angled space "D" (FIG. 1) exists between the bottom surface of the comb teeth 11 of the comb 10 and the upper surface 19 of the teeth 23 (second comb 14) with the outer ends of the combs defining the larger end of the angled space "D". This angled relation between the teeth 11 and teeth 23 define a path for the hair for the two sets of teeth 11 and 23 to condition the matted hair of the animal prior to cutting with the comb teeth 23 providing a first rough conditioning of the hair and the two sets of teeth prior to cutting providing a "finish" conditioning to the hair (i.e. unmatting, unsnarling etc). The longer teeth and wider spacing of the teeth 23 enhance untangling and the two sets of teeth 11 and 23 tend to straighten the hairs upwardly that there is presented to the cutting blades 9 substantially unmatted and straightened hairs thereby increasing the efficiency and use life of the device 1.

The secondary comb 14 also presents a straight surface continuity with the device body 2 relieving the stress on the shearers' wrist and arm and on the animal compared to the angled orientation of the comb 10. The secondary detachable comb 14 may be used with existing devices 1 or sold new as part of the device 1 initially.

FIGS. 5 and 6 show a smaller version of a conventional device 1 employing a smaller detachable secondary comb 14 and wherein like reference numerals and characters refer to like and corresponding to the device of FIGS. 1–4.

The comb 14 and device 1 produce substantially the same results as the device of FIGS. 1–4.

Whereas this invention is here illustrated and described with respect to several specific embodiments hereof it should be realized that various changes may be made without departing from the essential contributions to the art made by the teachings hereof.

I claim:

1. Electrical operated animal hair shearing or clipping device including an electric motor housing, blade means reciprocatable laterally by the motor, a first comb member carried by the device adjacent the blade means and a second comb member carried by the device adjacent the first comb member, with the first comb member being disposed between the blade means and the second comb member; wherein the first comb member is inclined outwardly and upwardly at an angle to the second comb member; the teeth of the second comb member extend outwardly a greater distance than the teeth of the first comb member; the first comb member has a plurality of teeth greater in number than the teeth of the second comb member; each pair of adjacent teeth of the first comb member diverge to their outer ends remote from the motor housing to form angled grooves open at their outer ends and the adjacent teeth of the second comb member extend from the motor housing substantially parallel to their outer ends to form a plurality of straight grooves open at their outer ends; the grooves of the first comb member are smaller in width than the grooves of the second comb member; the top surface of the second comb member includes a flat motor housing mounting surface and the top surface of the teeth of the second comb member are angled downwardly to the outer ends thereof; and wherein the flat surface of the second comb member is mountable to the underside of the motor housing and presents a flat bottom surface for the device.

2. Device of claim 1 wherein the grooves of both the comb members terminate adjacent the motor housing in mating downwardly angled arcuate portions to facilitate removal of cut hair from the vicinity of the device.

3. The device of claim 1 wherein the second comb member is removably mountable to the device and is provided with device mounting apertures coinciding with the device mounting apertures of the first comb member, and means for mounting both said combs to said device.

4. A removable comb member for mounting to an animal hair shearing or cutting device including hair cutting blade means and a first comb member, said first comb member being disposed between the blades and the second comb member when the second comb member is mounted to the device; wherein the first comb member is inclined upwardly and and outwardly at an angle to the bottom surface of the device; the teeth of the second comb member extend outwardly a greater distance than the teeth of the first comb member; the first comb member has a plurality of teeth greater in number than the teeth of the second comb member; each pair of adjacent teeth of the first comb member diverge to their outer ends remote from a motor housing of the device to form angled grooves open at their outer ends and the adjacent teeth of the second comb member extend from the motor housing substantially parallel to their outer ends to form a plurality of straight grooves open at their outer ends; the grooves of the first comb member are smaller in width than the grooves of the second comb member; the top surface of the second comb member includes a flat motor housing surface and the top surfaces of the teeth of the second comb member are angled downwardly to the outer ends thereof; and wherein the second comb member includes a flat surface and is mountable with said flat surface against the underside of the motor housing; and an additional bottom flat surface to present a flat bottom surface on the assembled device.

5. The comb member of claim 4 wherein the second comb member is removably mountable to the device and is provided with device mounting apertures coinciding with the device mounting apertures of the first comb member, and means for mounting both said combs to said device.

* * * * *